United States Patent [19]

Egger

[11] 3,933,428

[45] Jan. 20, 1976

[54] DEVICE FOR THE STERILIZATION OF PACKAGING MATERIAL

[75] Inventor: Hermann Egger, St. Ursen, Switzerland

[73] Assignee: Quepar S.A., Fribourg, Switzerland

[22] Filed: Dec. 4, 1973

[21] Appl. No.: 421,724

[30] Foreign Application Priority Data

Dec. 22, 1972 Italy ..... 54978

[52] U.S. Cl. ..... 21/93; 21/58; 21/81; 21/91; 53/167; 68/202; 118/259; 134/15; 222/414

[51] Int. Cl.[2] ..... A61L 3/00; B08B 1/02

[58] Field of Search ..... 21/91, 81, 58, 93; 134/9, 134/15; 222/414; 53/167; 68/200, 202; 118/259

[56] References Cited

UNITED STATES PATENTS

| | | | |
|---|---|---|---|
| 2,209,759 | 7/1940 | Berry | 134/9 |
| 3,170,382 | 2/1965 | Schwab et al. | 118/259 |
| 3,383,831 | 5/1968 | Goldsmith et al. | 53/167 |
| 3,468,286 | 9/1969 | Nugarus | 118/259 |
| 3,513,627 | 5/1970 | Doucette et al. | 21/91 |
| 3,692,468 | 9/1972 | Loliger et al. | 21/91 |
| 3,692,468 | 9/1972 | Loliger et al. | 21/91 |

*Primary Examiner*—Barry S. Richman
*Assistant Examiner*—Dale Lovercheck
*Attorney, Agent, or Firm*—Browdy and Neimark

[57] ABSTRACT

A sterilization apparatus for plastic webbing comprises a chamber containing one or more rollers having a porous surface. Disinfectant is fed through the porous roller surface as the webbing passes thereover, thus sterilizing the surface of the webbing.

2 Claims, 2 Drawing Figures

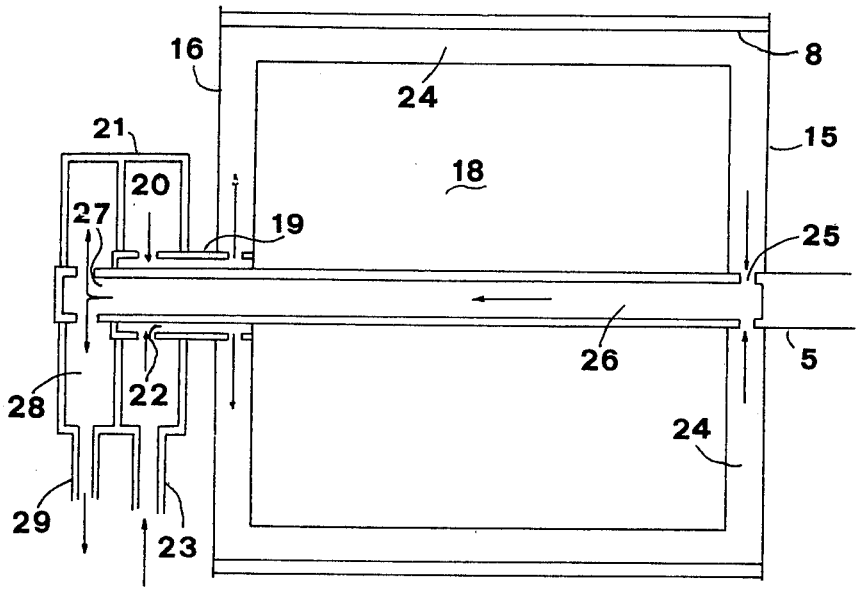
fig. 1
fig. 2
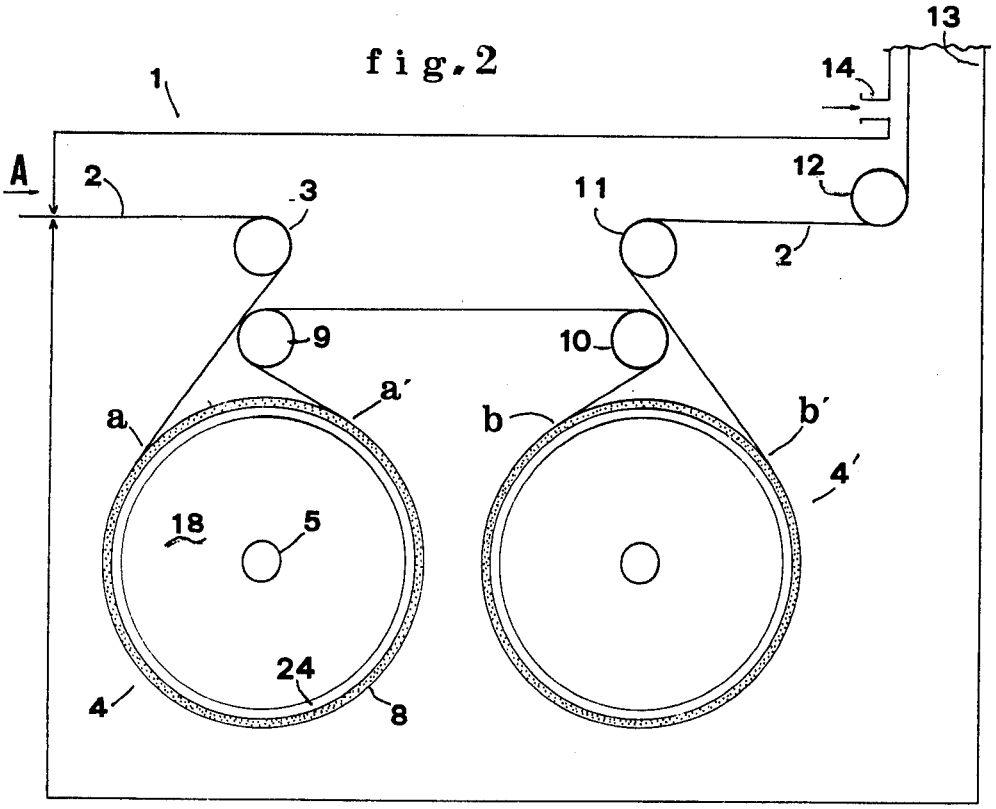

DEVICE FOR THE STERILIZATION OF PACKAGING MATERIAL

The invention refers to a device for sterilizing webs of packaging material preparatory to their processing by packaging machines.

The degree of sterilization of a surface depends, for a given sterilizing agent, on the temperature at which it is applied and on the length of its time of action upon said surface. Generally, the higher the temperature of the sterilant and the longer its action on the surface, the higher is its sterilizing effect.

Since for various considerations the temperature of the sterilant cannot be raised above certain limits, the sterilizing effect can only be increased by lengthening the contact time between sterilant and web surface. At the very high speeds, at which modern packaging machines process the web into finished packages, the obtaining of a sufficiently long contact between sterilant and that surface of the web, which will become the internal surface of the finished package and will therefore come into contact with its contents, once the package is filled, constitutes a major problem. Various proposals for its solution were made. One comprises a container filled with a hot hydrogen peroxide solution, and a guide roll dipping in it to keep the web completely immersed in the sterilant while it passes under the guide roll.

Among the disadvantages of this system are the waste of sterilant, which is also absorbed by the outer web surface, which requires no sterilization, and furthermore a strong discoloration of anything printed on said outer surface by the warm hydrogen peroxide.

In another proposal, a film of cold hydrogen peroxide is applied to the internal web face and is successively heated by radiators. This solution has the disadvantage that the heated sterilant film is evaporated before it has been sufficiently long in contact with the web.

It is therefore the object of the invention to supply a web sterilizing device, which eliminates the above mentioned drawbacks of the known art and permits prolonging at will the contact time between the internal web face and the sterilant, without the need of reducing thereby the speed at which the web is fed into the packaging machine.

The device according to the invention comprises: a closed vessel forming a sterilization chamber and having an inlet for the introduction of the web into it; an outlet connecting said chamber with the packaging machine; a plurality of drums rotatably mounted within said sterilization chamber and whose cylindrical surfaces are impregnated with a sterilant; guide means leading the internal web face along said impregnated drum surfaces and towards said outlet, and means to keep an overpressure of sterile air within said sterilization chamber to prevent the penetration of unsterile external air into its interior.

By varying the number and/or the circumference of the drums and/or the arc of contact between their impregnated surfaces and the web, the length of the contact time between web face and sterilant may be adjusted at will to the production speed of the packaging machine machine associated with the sterilizing device. This device eliminates any waste of sterilant, since it merely applies it to the internal web face, and removes it therefrom before the web enters the packaging machine, thereby eliminating the danger that the sterilant impairs the taste of the packaged goods.

These and other advantages of the invention will clearly result from the following detailed description of one of its possible embodiments, made with reference to the figures of the attached drawing, wherein:

FIG. 1 is a schematic, partly sectional elevation of the embodiment;

FIG. 2 is a cross sectional view through one drum and its sterilant-circulating system.

With reference to the FIGURES, the closed vessel forming the sterilization chamber of the web is generally indicated at 1. The web of packaging material 2 is introduced into the chamber 1 through a slit 1*a* in one of its walls, in the direction indicated by the arrow A. Within the chamber, a guide roll 3 leads the web 2 towards the sterilant-impregnated surface 8 of a first drum 4. After having travelled around the major part of the drum circumference, web 2 passes over guide rolls 9 and 10, thence around the major part of the sterilant-impregnated surface 8 of a second drum 4', thence over a guide roll 11, a squeeze roll 12 having the double purpose of wiping any remaining sterilant from its interior face and leading it towards the outlet of the sterilization chamber. It is obvious that the web 2 enters the sterilization chamber in a position in which its internal face will contact the impregnated drum surfaces when led around them. The pairs of guide rolls 3, 9 and 10, 11 respectively are positioned in such a manner as to extend the contact between web and drum surface over the greatest possible arc of the drum circumference, such as from the generatrix *a'* to *a* on drum 4 and *b* to *b'* on drum 4'. The outlet of the sterilization chamber forms a duct 13, which tightly connects the chamber with the packaging machine (not shown,) so as to prevent the reinfection of the web during its transition from the chamber to the machine. Warm sterile air at a temperature of approximately 80°C is blown through a pipe 14 into the duct 13, so as to pass first along the interior web face and evaporate any sterilant still adhering to it, and thence into the chamber interior, to create an overpressure therein, and to issue finally through slit 1a, to prevent the inflow of unsterile external air through it.

An advantageous way of impregnating the cylindrical surfaces 8 with sterilant is schematically shown in FIG. 2. Each drum comprises a hollow external cylinder 17 formed by said permeable surface 8 and two flanges 15 and 16. The external cylinder encloses an internal cylinder 18, coaxial with it. Both cylinders are rigidly mounted on a shaft 5 and define between them a space 24. A hollow shaft 19, of a diameter larger than shaft 5 and coaxial with it is fastened, as by welding, to one side of the internal cylinder 18, passes through flange 16, to which it is welded, and penetrates, with a tight fit, into the inlet compartment 20 of a stationary distributor 21, within which it is rotatable. The chamber 22 formed between shaft 19 and 5 communicates through inlet apertures in the wall of shaft 19 with the sterilant emitted into compartment 20 through the input pipe 23 and with the space 24 through outlet apertures located in the wall of shaft 19 correspondingly to said space. This arrangement permits a warm liquid sterilant, such as hydrogen peroxide, to flow from pipe 23 into the space 24 during the rotation of the drum. Part of the sterilant impregnates the permeable surface 8, while the remaining sterilant enters from space 24 into an axially extending passage 26 of shaft 5 located between flange 15 and the adjacent end of the internal cylinder 18. From passage 26 the sterilant flows, through outlet holes 27 provided in the wall of shaft 5 into a discharge compartment 28 of distributor 21 and thence through the outlet pipe 29 to a reheating station 30 (shown schematically), where it is brought back to its operational temperature and recirculated into the drum through pipe 23.

The permeable surface 8 may be either a porous metal, such as sintered stainless steel, or a plastic foam with open cells, supported by a rigid metal grid or mesh. The drums are entrained in rotation by the web and rotate therefore with the speed at which the web travels, with no danger of tearing, scratching or otherwise damaging its surface. The sterilant preferably used is hydrogen peroxide, which is easily evaporated from the web surface before it enters the packaging machine.

It is obvious that many changes may be brought to the here described arrangement of the drums and to the system of impregnation of their surfaces with sterilant, without departing from the idea of the invention.

What is claimed is:

1. A device for the sterilization of packaging material comprising:

a closed sterilization chamber;

a plurality of drums rotably mounted within said chamber, each of said drums comprises a hollow external cylinder having a permeable cylindrical surface impregnated with a heated sterilant, said hollow external cylinder enclosing a smaller cylinder, both said external cylinder and said smaller cylinder being coaxially and rigidly attached to a common shaft, said hollow cylinder and said smaller cylinder having a space therebetween;

guide means for leading packaging material along said impregnated drum surfaces;

overpressurizing means for keeping an overpressure of sterile air within said sterilization chamber to prevent unsterile external atmosphere from penetrating into the interior of said chamber; and means for circulating the heated sterilant within said space which comprises: a stationary distributor having an inlet compartment having an interior and an outlet compartment for the sterilant; a hollow shaft surrounding said common shaft to define a fluid chamber with said common shaft and extending from the interior of said inlet compartment to said space; inlet and outlet apertures in the walls of said hollow shaft corresponding respectively to said inlet compartment and said space to permit the inflow of sterilant to said space; and an axially extending passage within said common shaft to communicate said space with said outlet compartment of said distributor.

2. A device according to claim 1, wherein means for reheating the sterilant is connected to said outlet compartment and said inlet compartment to reheat sterilant flowing therebetween.

* * * * *

UNITED STATES PATENT OFFICE

CERTIFICATE OF CORRECTION

Patent No. 3,933,428 Dated January 20, 1976

Inventor(s) Hermann Egger

It is certified that error appears in the above-identified patent and that said Letters Patent are hereby corrected as shown below:

On the cover sheet item "[73]" should read as follows:

-- Assignee: Quepor S.A., Fribourg, Switzerland --.

Signed and Sealed this

Sixth Day of July 1976

[SEAL]

*Attest:*

RUTH C. MASON
*Attesting Officer*

C. MARSHALL DANN
*Commissioner of Patents and Trademarks*

UNITED STATES PATENT AND TRADEMARK OFFICE

Certificate

Patent No. 3,933,428 Patented December 4, 1973

Hermann Egger

Application having been made by Hermann Egger, the inventor named in the patent above identified, and International Paper Co., the assignee, for the issuance of a certificate under the provisions of Title 35, Section 256, of the United States Code, deleting the name of Hermann Egger and adding the name of Silvano Moscatelli as sole inventor, and a showing and proof of facts satisfying the requirements of the said section having been submitted, it is this 26th day of Mar., 1985, certified that the name of the said Hermann Egger is hereby deleted from the said patent as sole inventor and the name of the said Silvano Moscatelli is hereby added to the said patent as sole inventor.

Fred W. Sherling,
*Associate Solicitor.*